US009217945B2

(12) United States Patent
Hosohara et al.

(10) Patent No.: US 9,217,945 B2
(45) Date of Patent: Dec. 22, 2015

(54) BELT CONVEYING APPARATUS AND IMAGE FORMING APPARATUS

(71) Applicant: CANON KABUSHIKI KAISHA, Tokyo (JP)

(72) Inventors: Kazuhiro Hosohara, Kawasaki (JP); Takeo Kawanami, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/090,201

(22) Filed: Nov. 26, 2013

(65) Prior Publication Data

US 2014/0147178 A1 May 29, 2014

(30) Foreign Application Priority Data

Nov. 29, 2012 (JP) ..... 2012-261453

(51) Int. Cl.
*G03G 15/01* (2006.01)
*G03G 15/16* (2006.01)

(52) U.S. Cl.
CPC ..... *G03G 15/0136* (2013.01); *G03G 15/1615* (2013.01); *G03G 2215/0132* (2013.01)

(58) Field of Classification Search
CPC ..... G03G 15/0136; G03G 15/1615; G03G 2215/0132; G03G 2215/1623; G03G 2221/1642
USPC ..... 399/298–299, 302
See application file for complete search history.

(56) References Cited

U.S. PATENT DOCUMENTS

| | | | | |
|---|---|---|---|---|
| 2007/0071486 | A1* | 3/2007 | Chiba et al. | 399/101 |
| 2009/0067881 | A1* | 3/2009 | Kitagawa | 399/121 |
| 2011/0008078 | A1* | 1/2011 | Takahashi et al. | 399/302 |
| 2011/0013919 | A1* | 1/2011 | Matsuda | 399/49 |
| 2013/0136498 | A1* | 5/2013 | Ju et al. | 399/121 |
| 2014/0169840 | A1* | 6/2014 | Yokoyama et al. | 399/298 |
| 2014/0314431 | A1* | 10/2014 | Morihara et al. | 399/46 |
| 2015/0063879 | A1* | 3/2015 | Yuasa | 399/302 |

FOREIGN PATENT DOCUMENTS

| | | | | |
|---|---|---|---|---|
| JP | 2006-350259 A | | 12/2006 | |
| JP | 2007-079570 A | | 3/2007 | |
| JP | 2007212934 A | * | 8/2007 | G03G 21/16 |

* cited by examiner

*Primary Examiner* — Christopher Mahoney
(74) *Attorney, Agent, or Firm* — Canon U.S.A., Inc. IP Division

(57) ABSTRACT

Provided is a small sized belt conveying apparatus provided with a separating unit configured to move a transfer member and an image forming apparatus provided with the belt transfer apparatus. The image forming apparatus includes a drive unit configured to transmit a drive force from a drive source provided in an apparatus body, and a drive transmitting unit configured to transmit the drive force branched and transmitted from the drive unit. The separating unit is configured to move the transfer member by a drive force transmitted by the drive transmitting unit via the drive unit.

16 Claims, 8 Drawing Sheets

BELT CONVEYING APPARATUS AND IMAGE FORMING APPARATUS

BACKGROUND OF THE INVENTION

1. Field of the Invention

This disclosure relates to a belt conveying apparatus configured to circulate an endless belt in a state of being stretched by a plurality of stretching members, and an image forming apparatus such as a printer or a copying machine provided with the belt conveying apparatus and employing an electrophotographic system.

2. Description of the Related Art

In the related art, examples of known image forming apparatuses configured to output color images include a tandem type image forming apparatus including a plurality of photoconductive drums arranged along an intermediate transfer belt. The image forming apparatus provided with the intermediate transfer belt is configured to form toner images having different colors on the photosensitive drums respectively, superimpose these toner images on the intermediate transfer belt in sequence as a primary transfer to form a color toner image. Subsequently, the image forming apparatus transfers the color toner image to a transfer medium passing between the intermediate transfer belt and a secondary transfer roller that is in contact with the intermediate transfer belt as a secondary transfer to output a color image on the transfer medium.

The color image forming apparatuses as described above generally have a color mode in which images are formed by using toners in four colors (yellow, magenta, cyan, and black) and a monochrome mode in which images are formed by using a toner in one color (generally, black toner). In the color mode, the primary transfer is performed by bringing all the photosensitive drums into contact with the intermediate transfer belt. In the monochrome mode, the primary transfer is performed by bringing only one of the photosensitive drums (generally, the photosensitive drum for black color) into contact with the intermediate transfer belt while separating the other photosensitive drums from the intermediate transfer belt. In this configuration, components to be used in image formation (for example, the photosensitive drums, a developer, and so forth), which are not involved in monochrome image formation, are not consumed unnecessarily.

As an example of configurations, which can select one of the monochrome mode and the color mode as described above by switching a contact state of the respective photosensitive drums with the intermediate transfer belt, Japanese Patent Laid-Open No. 2007-79570 discloses a configuration that is provided with a separating unit configured to move a plurality of the transfer members for the primary transfer arranged corresponding to the respective photosensitive drums.

However, the configuration disclosed in Japanese Patent Laid-Open No. 2007-79570 needs to provide a specific drive source for moving the transfer members. Therefore, a space for arranging the specific drive source is necessary, and hence reduction in size of the belt conveying apparatus is difficult when the drive source is provided in the belt conveying apparatus. In a case where the drive source is provided in an apparatus body, a specific space for the drive source is needed in the apparatus body, and hence reduction in size of the apparatus body is difficult.

SUMMARY OF THE INVENTION

The disclosure provides a belt conveying apparatus which allows reduction in size by moving a transfer member without providing a specific drive source and an image forming apparatus provided with the belt conveying apparatus.

This disclosure provides a belt conveying apparatus provided in an image forming apparatus that is configured to transfer a toner image from an image bearing member that carries the toner image to a transfer medium, including: an endless belt that moves in a direction of conveyance; a plurality of stretching members configured to stretch the endless belt; a drive roller, which is one of the plurality of stretching members, configured to stretch the endless belt and convey the endless belt; a transfer member arranged corresponding to the image bearing member configured to carry the toner image via the endless belt; a separating unit configured to cause the transfer member to move to a pressing position where the image bearing member is pressed via the endless belt and a separated position separated from the image bearing member in comparison with the pressing position; a drive unit configured to transmit a drive force from a drive source provided in an apparatus body to the drive roller, and a drive transmitting unit configured to transmit the drive force branched and transmitted from the drive force to the separating unit, wherein the separating unit moves the transfer member by the drive force transmitted by the drive transmitting unit via the drive unit.

An image forming apparatus including: a drive source;

a plurality of image bearing members configured to carry a tonner image; and a belt conveying apparatus configured to convey toner images for transferring the toner images carried by the plurality of image bearing members to a transfer material, the belt conveying apparatus including: an endless belt that moves in the direction of belt conveyance; a plurality of stretching members configured to stretch the endless belt; a drive roller, which is one of the plurality of stretching members, and configured to stretch the endless belt and convey the endless belt; a plurality of transfer members arranged corresponding to the plurality of image bearing members configured to carry the toner image thereon via the endless belt, and a separating unit configured to move at least one of the plurality of transfer members to a pressing position where the image bearing members are pressed via the endless belt and a separated position separated from the image bearing members in comparison with the pressing position, wherein the belt conveying apparatus includes: a drive unit configured to transmit a drive force from the drive source to the drive roller, and a drive transmitting unit configured to transmit the drive force branched and transmitted from the drive unit to the separating unit, wherein the separating unit moves the transfer member by a drive force transmitted by the drive transmitting unit via the drive unit.

Further features of the present invention will become apparent from the following description of exemplary embodiments with reference to the attached drawings.

DESCRIPTION OF THE EMBODIMENTS

Figure 1A:
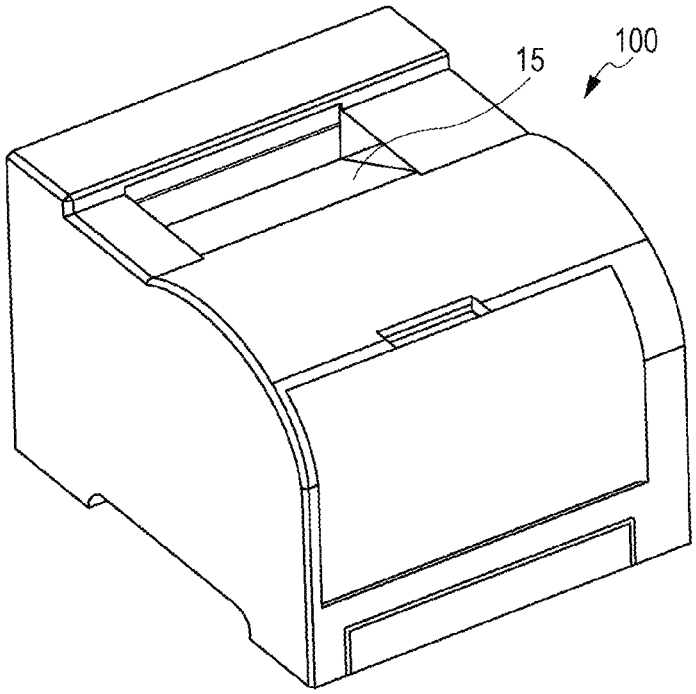
FIGS. 1A and 1B are a schematic perspective view and a schematic cross-sectional view, respectively, of an image forming apparatus provided with a belt conveying apparatus.

Referring now to the drawings, preferable embodiments of this invention will be described in detail. Note that, sizes, materials, shapes of the components and relative arrangement of these components described in the embodiments below are to be modified as needed according to a configuration of an apparatus to which this invention is applied, and various conditions. Therefore, unless otherwise specifically described, the embodiments are not intended to limit the scope of this invention thereto.

First Embodiment

General Configuration of Image Forming Apparatus

Figure 1B:
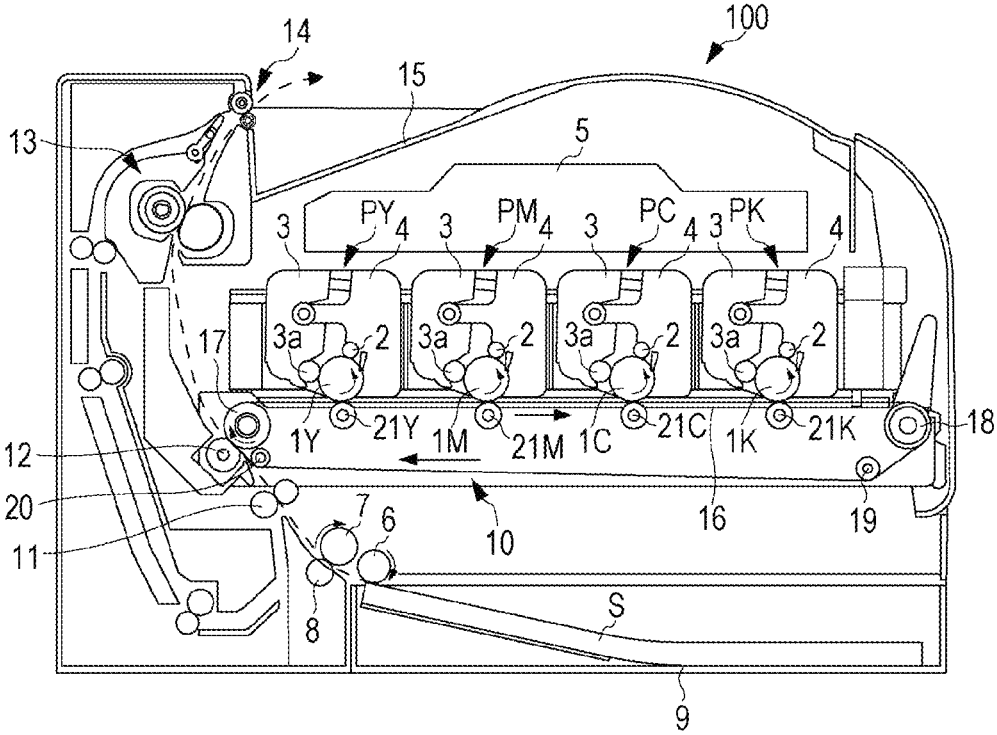

FIGS. 1A and 1B are schematic views illustrating an example of a color image forming apparatus, and a configuration of an image forming apparatus of this embodiment will be described with reference to FIGS. 1A and 1B. An image forming apparatus 100 is allowed to form images on a transfer member S such as a recording sheet or an OHP sheet on the basis of an electrophotographic system according to a signal sent from an external apparatus such as a personal computer connected to the image forming apparatus 100 so as to be capable of communicating each other, and output the transfer member to an output tray 15.

A plurality of image forming units PY, PM, PC, and PK configured to form toner images of yellow, magenta, cyan, and black respectively are arranged linearly in a substantially horizontal direction in the image forming apparatus 100. A belt conveying apparatus is arranged so as to face the image forming units PY, PM, PC, and PK. The belt conveying apparatus of this embodiment is a unified transfer unit including an intermediate transfer belt 16 and other members and is a belt conveying apparatus configured to convey the belt 16.

The transfer unit of this embodiment is an intermediate transfer unit 10 configured to circulate the endless belt (an intermediate transfer belt) 16, which is an intermediate transfer member stretched by stretching members 17, 18, 19, and 20, so as to face the image forming units PY, PM, PC, and PK. Here, the direction of circulation of the intermediate transfer belt 16 corresponds to the direction of belt conveyance.

The plurality of image forming units PY, PM, PC, and PK are configured to be removably installed on an apparatus body as first to fourth process cartridges, respectively. The cartridges have the same configuration except for a toner color stored therein. Each of the cartridges of this embodiment has a photoconductive drum 1 as a first image bearing member, a charging member 2 as a process unit configured to act on the photoconductive drum, a developing device 3, and a cleaning unit 4 that are integrally assembled to a cartridge frame. The charging member used here is the charging roller 2. The developing device 3 includes a developing roller 3*a* and a developer container, and developer (toner) is stored in the developer container. The cleaning device 4 which may be used here is of a blade type.

The first cartridge, PY, includes yellow (Y) toner stored in a corresponding developing device 3 to form a yellow toner image on the surface of the drum 1. The second cartridge, PM, includes magenta (M) toner stored in a corresponding developing device 3 to form a magenta toner image on the surface of the drum 1. The third cartridge, PC, includes cyan (C) toner stored in a corresponding developing device 3 to form a cyan toner image on the surface of the drum 1. The fourth cartridge, PK, includes black (K) toner stored in a corresponding developing device 3 to form a black toner image on the drum 1 surface.

A laser scanner unit 5 is disposed above the cartridges PY, PM, PC, and PK as an exposure unit. The laser scanner unit 5 outputs laser light modulated corresponding to image information of the respective color input from the external host apparatus, and performs a scanning exposure to the drum surfaces of the respective cartridges.

Since the cartridges PY, PM, PC, and PK have the same configuration and function except for the toner colors for forming respective images, the configuration of the cartridge PY will be described as a representative. The cartridge PY forms a toner image by a known electrophotographic image forming process. The cartridge PY is provided with a cylindrical electrophotographic photosensitive member as an image bearing member, that is, a photoconductive drum 1Y so as to be rotatable in the direction indicated by an arrow in the drawing. In the image forming operation, first of all, the charging roller 2 charges the surface of a rotating photoconductive drum 1*a*.

Subsequently, the scanner unit 5 emits light according to a signal sent from a computer, and performs a scanning exposure to the surface of the charged photoconductive drum 1Y, whereby an electrostatic latent image is formed on the photoconductive drum 1Y. The electrostatic latent image formed on the photoconductive drum 1Y receives a supply of toner from the developing roller 3*a*, and is visualized as a toner image. The toner image visualized on the photoconductive drum 1Y is transferred electrostatically onto the belt 16 by the action of a primary transfer roller 21Y, which is a primary transfer member arranged so as to oppose the photoconductive drum 1*a* via the belt 16 in a primary transfer portion. Primary-transfer residual toner, which is toner remaining on the surface of the photoconductive drum 1 is cleaned and removed by the cleaning unit 4, and then is used in an image forming process after charging onward.

Through the process as described above, the toner images formed on the respective photoconductive drums 1*a* of the cartridges PY, PM, PC, and PK are transferred onto the belt 16 in sequence at proper timings with respect to the movement of the belt 16 so as to be superimposed on top of one another, so that a color toner image is formed.

In contrast, a pickup roller 6 and a feed roller 7 are driven at predetermined control timings. One of the transfer media S stacked on a sheet supplying cassette 9 is separately fed by the pickup roller 6, and is conveyed by the feed roller 7 and a separating roller 8. The transfer medium S passes between a pair of registration rollers 11, and is introduced into a nip (secondary transfer nip) between a secondary transfer roller 12 and the intermediate transfer belt 16. Accordingly, the color toner image on the intermediate transfer belt 16 is transferred to the surface of the transfer medium S in order at once by a process of being conveyed through the nip.

The transfer medium S is separated from the surface of the intermediate transfer belt 16 and is introduced into a fixing apparatus 13, and is heated and pressurized at a fixing nip. Accordingly, color mixing and fixation of the toner images of the respective colors onto the transfer medium are achieved. Then, the transfer medium S is output onto the output tray 15 by a pair of paper discharge rollers 14.

The image forming apparatus 100 is capable of executing the operation in a color mode in which images are formed by using toners in four colors (yellow, magenta, cyan, and black), and in a monochrome mode in which the image is formed by using only black toner. In the color mode, all the photoconductive drums are pressed by the intermediate transfer belt 16. At this time, all the primary transfer members are positioned at pressing positions so as to press the intermediate transfer belt 16 against the photoconductive drums.

In the monochrome mode, only the photoconductive drum 1K for the black toner is in contact with the intermediate transfer belt. In the monochrome mode, the photoconductive drums 1Y, 1M, and 1C for yellow, magenta, and cyan toners, which are not in charge of image formation, are kept away from the intermediate transfer belt 16, and the developing device 3 is also kept away from the intermediate transfer belt 16, so that unnecessary consumption is suppressed. At this time, the primary transfer member corresponding to black color is positioned at the pressing position so as to press the intermediate transfer belt 16 against the photoconductive drum. The primary transfer members corresponding to colors other than black color are positioned at separated positions away from the intermediate transfer belt 16 in comparison with the pressing positions thereof. The image forming process in the monochrome mode is the same as the color mode. The description will be omitted.

Contact states between the intermediate transfer belt 16 and the photoconductive drums 1Y, 1M, 1C, and 1K are switched by moving the primary transfer members in this embodiment. In this embodiment, primary transfer rollers 21Y, 21M, 21C, and 21K as the primary transfer members are moved away from the intermediate transfer belt 16 by a separating unit 24. The respective primary transfer rollers do not necessarily have to be away from the intermediate transfer belt 16 completely and the separating unit 24 needs only to move the respective primary transfer rollers to positions away from the corresponding photoconductive drums in comparison with positions taken in the contact state.

Configuration of Intermediate Transfer Unit

Figure 2:
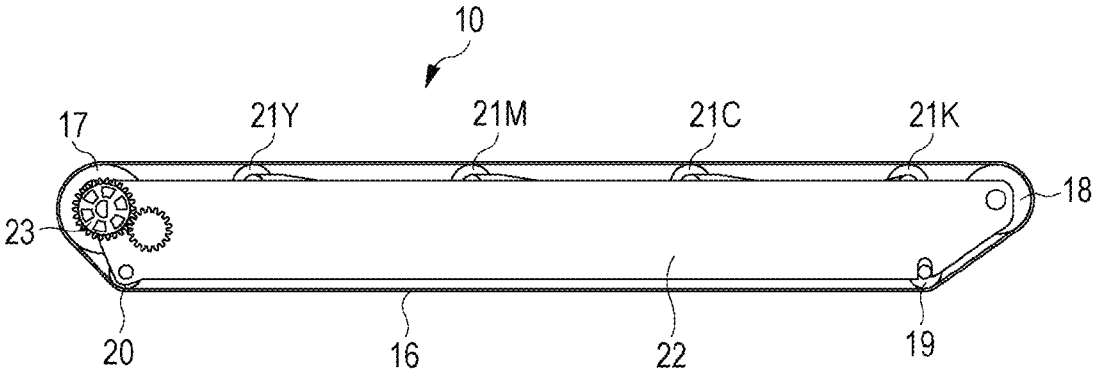
FIG. 2 is a schematic side view of the belt conveying apparatus.
Figure 3:
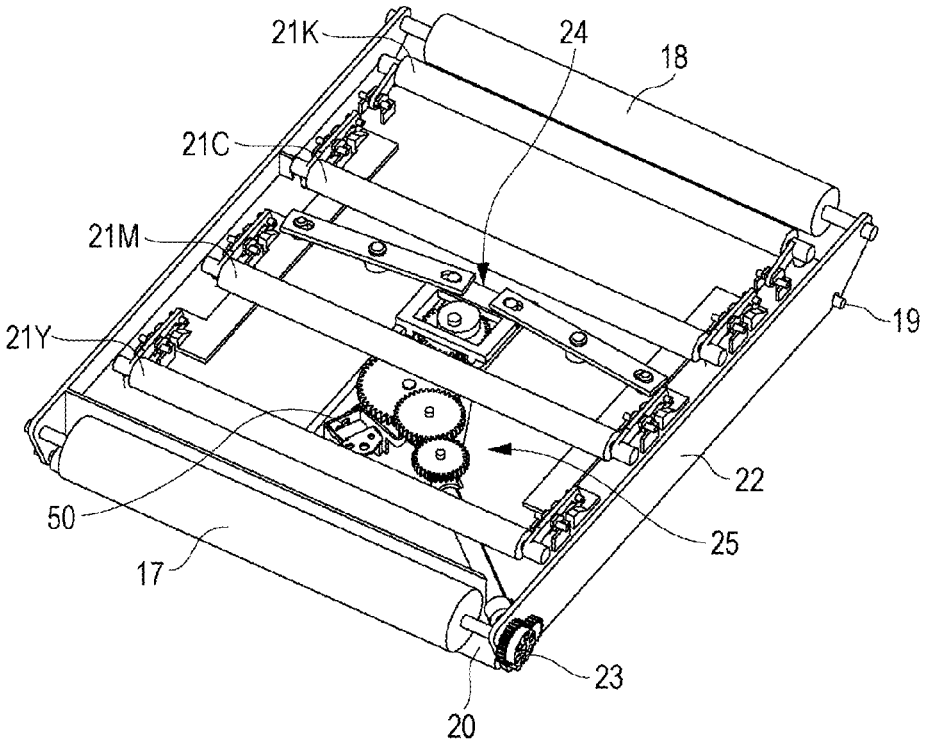
FIG. 3 is a schematic perspective view of the belt conveying apparatus illustrating a state in which a belt is removed.

Subsequently, the configurations of the intermediate transfer belt 16, and the separating unit 24 configured to move the primary transfer members will be described with reference to FIG. 2 and FIG. 3. FIG. 2 is a schematic side view of the intermediate transfer unit in the first embodiment, and FIG. 3 is a schematic perspective view illustrating a state in which the belt 16 of the intermediate transfer unit 10 is removed.

The intermediate transfer unit 10 is provided with the endless and movable intermediate transfer belt 16 and stretching rollers as the plurality of stretching members configured to stretch the intermediate transfer belt 16. The stretching rollers include the driving roller 17 configured to circulate the intermediate transfer belt 16, the driven roller 18 configured to be rotated by the movement of the intermediate transfer belt 16, the auxiliary roller 20, and the tension roller 19. In a belt width direction, which is a direction orthogonal to the direction of movement of the intermediate transfer belt 16, supporting plates configured to support the respective stretching rollers are provided on both ends of the respective stretching rollers. The intermediate transfer unit 10 is provided with an intermediate transfer unit frame 22, which is a frame portion including these supporting plates. The respective stretching rollers are supported by the intermediate transfer unit frame 22. The tension roller 19 is urged from the inside to the outside of the intermediate transfer belt 16 by a tension spring, not illustrated, to provide the intermediate transfer belt 16 with a tension.

Four of the primary transfer rollers 21Y, 21M, 21C, and 21K are arranged at positions corresponding to the photoconductive drums 1Y, 1M, 1C, and 1K on the inside of the intermediate transfer belt 16. These primary transfer rollers are arranged so as to bring the intermediate transfer belt 16 into pressure-contact with the respective photoconductive drums 1 and face the photoconductive drums via the intermediate transfer belt 16. When employing metallic rollers as the primary transfer rollers, the primary transfer rollers may be arranged at positions shifted from the respective photoconductive drum 1 so as to avoid the contact with the respective photosensitive drums 1 via the intermediate transfer belt 16. Alternatively, members other than the rollers may be employed as the primary transfer members, and a configuration in which the primary transfer members are in contact with the intermediate transfer belt 16 via fixed surfaces and not moved by the intermediate transfer belt 16 may also be employed.

The separating unit 24 configured to move the respective primary transfer rollers 21Y, 21M, 21C, and 21K is arranged between the supporting plate and the supporting plate in the belt width direction, that is, in the intermediate transfer unit frame 22. A drive source is connected to one of the supporting plates of the intermediate transfer unit frame 22, and a drive unit 23 configured to transmit the drive force from the drive source to the separating unit 24 is provided. The separating unit 24 is arranged at a center position in the belt width direction orthogonal to the direction of conveyance of the intermediate transfer belt 16. The position of the separating unit 24 may be a position other than the center as long as it is located on the inside the both ends of the intermediate transfer belt 16.

Configuration of Separating Unit 24

Figure 4A:
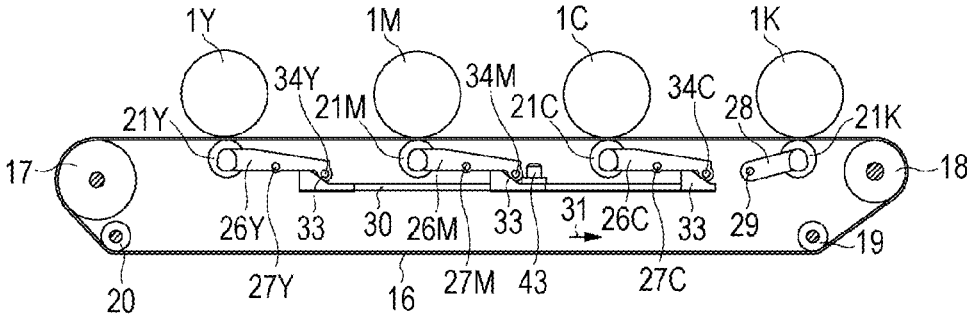
FIGS. 4A and 4B are schematic cross-sectional views illustrating a pressing state and a separated state, respectively, of a transfer member.
Figure 4B:
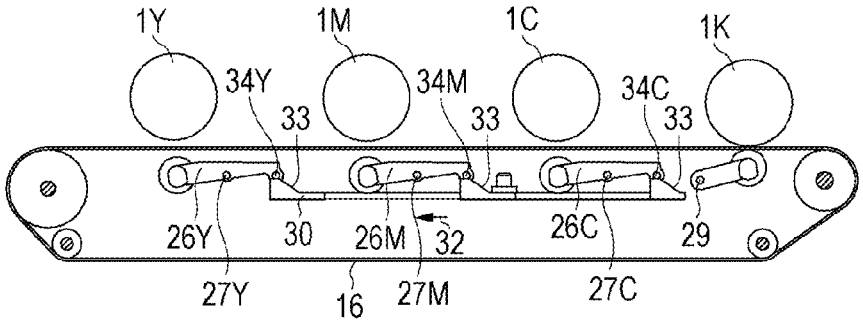

Subsequently, the separating unit 24 of this embodiment will be described with reference to FIG. 4A to FIG. 6B. FIGS. 4A and 4B are schematic cross-sectional views for explaining the contact and separate operations of the respective primary transfer rollers. FIG. 4A illustrates a state in which the intermediate transfer belt 16 is in contact with all the photoconductive drums 1Y, 1M, 1C, and 1K. FIG. 4B illustrates a state in which the photoconductive drums 1Y, 1M, and 1C other than the photoconductive drum 1K for black are separated from the intermediate transfer belt 16 in order to form a monochrome image. The separating unit 24 is provided at least with cam sliders 30, which are position control members configured to control the positions of the transfer members.

The primary transfer rollers 21Y, 21M, and 21C are rotatably supported by bearing link members 26Y, 26M, and 26C arranged at both ends in the belt width direction, respectively. FIG. 4A illustrates a bearing link member on one side in the belt width direction. A configuration on the other side is substantially the same.

The bearing link members 26Y, 26M, and 26C are supported so as to be pivotable about the primary transfer rollers 21Y, 21M, and 21C. Rotating shafts 27Y, 27M, and 27C are urged by transfer spring, not illustrated, toward the photoconductive drums 1Y, 1M, and 1C corresponding thereto, respectively.

The primary transfer roller 21K is rotatably supported by bearing members 28 arranged respectively on both ends in the belt width direction. The bearing member 28 is supported so as to be pivotable about a rotating shaft 29, and the primary transfer roller 21K is urged by a transfer spring, not illustrated, toward the opposing photoconductive drum 1K.

The cam slider 30, which is the position control member, is provided so as to be movable with respect to the intermediate transfer unit frame 22 in a direction substantially orthogonal to a pressing direction of the transfer spring (directions indicated by arrows 31 and 32 in FIGS. 4A and 4B). The cam slider 30 includes a cam bevel 33. When the cam slider 30 moves in the direction indicated by the arrow 31 from the state illustrated in FIG. 4A, contact portions 34Y, 34M, and 34C with respect to cam sliders provided at end portions of the bearing link members 26Y, 26M, and 26C come into contact with the cam bevel 33. By this contact, the bearing link members 26Y, 26M, and 26C pivots about respective rotating shafts, and move the primary transfer rollers 21Y, 21M, and 21C in a direction away from the photoconductive drums 1Y, 1M, and 1C.

When the cam slider 30 moves in the direction indicated by the arrow 32 from the state illustrated in FIG. 4B, contact of the contact portions 34Y, 34M, and 34C with respect to the cam sliders provided at ends of the bearing link members 26Y, 26M, and 26C is released. When released, the primary transfer rollers 21Y, 271M, and 21C are brought into a state being pressed toward the photoconductive drums 1Y, 1M, and 1C as illustrated in FIG. 4A. As described above, the positions of the primary transfer rollers 21Y, 21M, and 21C are controlled by the movement of the cam slider 30.

Figure 5:
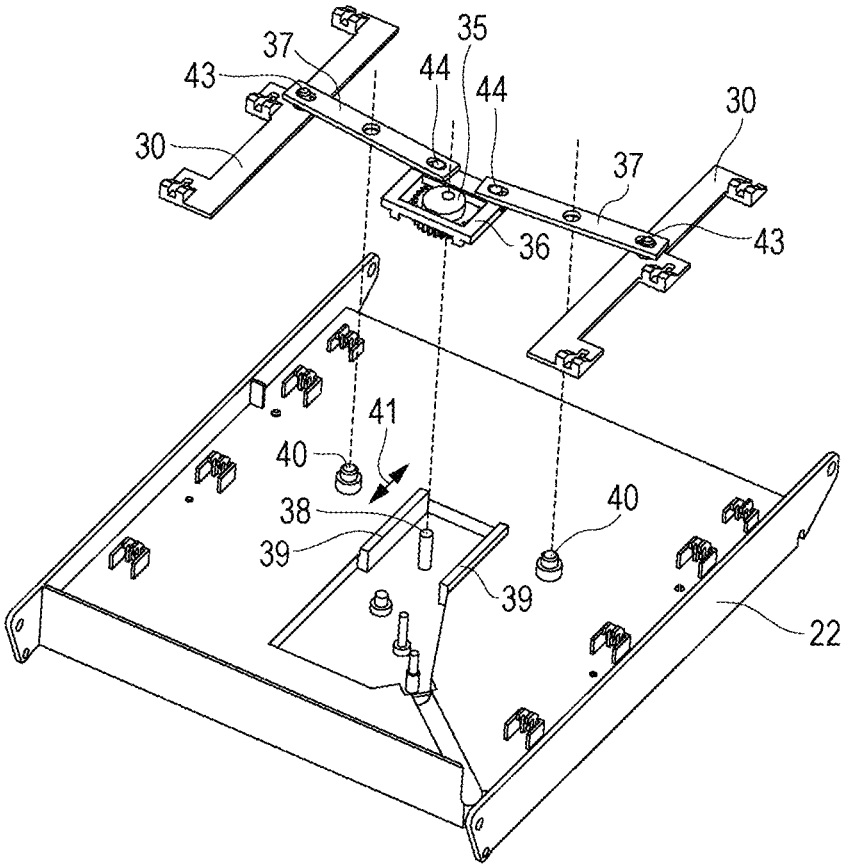
FIG. 5 is a schematic perspective view for explaining a separating unit.

Subsequently, a configuration in which the cam slider 30 is moved will be described with reference to FIG. 5. FIG. 5 is a schematic perspective view for explaining the separating unit 24. The separating unit 24 includes a rotating cam 35, a cam follower 36, and link rods 37 which is a link member in addition to the cam sliders 30 described above. The rotating cam 35, which is a cam member, is supported so as to be rotatable about a rotation center 38 of the rotating cam with respect to the intermediate transfer unit frame 22. The cam follower 36 is restricted in direction of movement by a cam follower guide portion 39 provided in the intermediate transfer unit frame 22, and is supported by the intermediate transfer unit frame 22 so as to be freely movable in the direction of an arrow 41 in association with the rotation of the rotating cam 35. The cam slider 30 is supported by the intermediate transfer unit frame 22 so as to be freely movable in the direction indicated by the arrow 41 by a movement restricting rib, not illustrated. The link rods 37 are supported by the intermediate transfer unit frame 22 so as to be pivotable about the link rod pivot centers 40 as pivot centers.

Figure 6A:
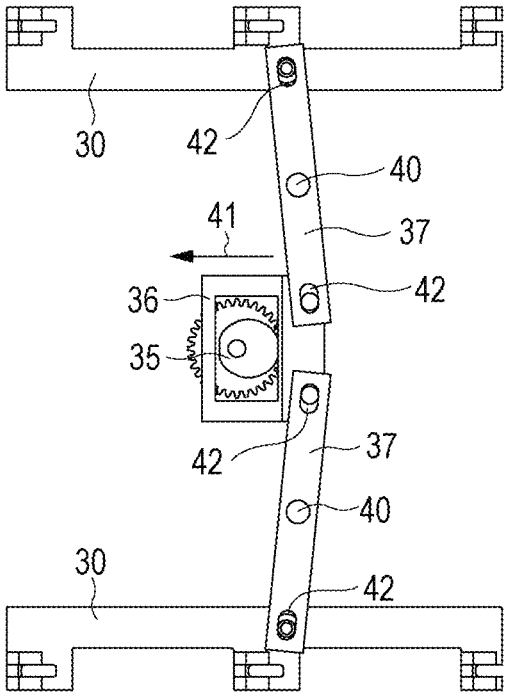
FIGS. 6A and 6B are schematic top views illustrating the separating unit in a pressing state and a separating state, respectively, of the transfer member.
Figure 6B:
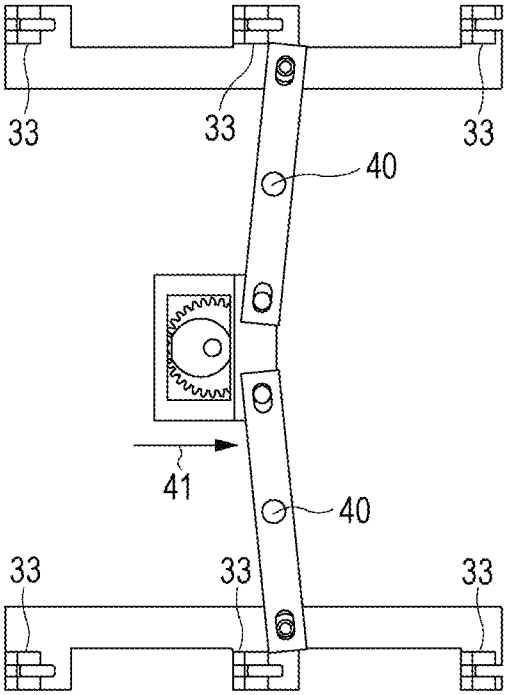

FIG. 6A is a view for explaining the state of the separating unit 24 in a contact state (pressing state) of the primary transfer roller, and FIG. 6B is a view for explaining the state of the separating unit 24 in a state in which the primary transfer roller is in the separating state. Referring now to FIGS. 6A and 6B, the movement of the separating unit 24 will be described.

Elongated holes 42 provided at both ends of the link rod 37 engage an engaging boss 43 of the cam slider 30 at one end thereof and engage an engaging boss 44 of the cam follower 36 at the other end thereof. With the provision of the link rods 37, the cam sliders 30 are allowed to move in a direction substantially parallel to the surface of the belt in conjunction with the movement of the cam follower 36.

The driving of the rotating cam 35 is selectively controlled between the position illustrated in FIG. 6A and the position illustrated in FIG. 6B by a drive transmitting route, described later. When the rotating cam 35 rotates from the state illustrated in FIG. 6A by approximately 180°, an inner wall of the cam follower 36 slides and the cam follower 36 restricted in the direction of movement by the cam follower guide portion 39 moves in the direction indicated by the arrow 41. In association with the movement of the cam follower 36, link rods 37 engaged therewith via the link rod elongated holes 42 pivot about the link rod pivot centers 40 as a pivot center. The cam sliders 30 engage the link rod 40 via the engaging boss 43 of the cam slider, and hence move in the direction opposite to the direction of movement of the cam follower 36, so that the state illustrated in FIG. 6B is assumed.

When the rotating cam 35 rotates from the state illustrated in FIG. 6B by approximately 180°, the cam follower 36 moves in the direction of the arrow 41, so that the state illustrated in FIG. 6A is returned. As described thus far, the movement of the cam sliders 30 may be controlled by selectively controlling the position of the rotating cam 35 at every approximately 180°, whereby the contact and separation actions of the primary transfer rollers 21Y, 21M, and 21C may be controlled.

Drive Transmitting Route to Rotating Cam

Figure 7A:
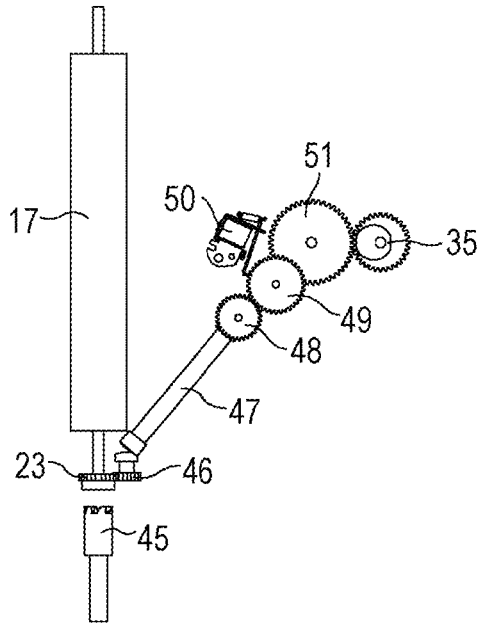
FIGS. 7A and 7B are a schematic top view and a schematic perspective view, respectively, of a drive transmitting unit configured to transmit a drive force to the separating unit.
Figure 7B:
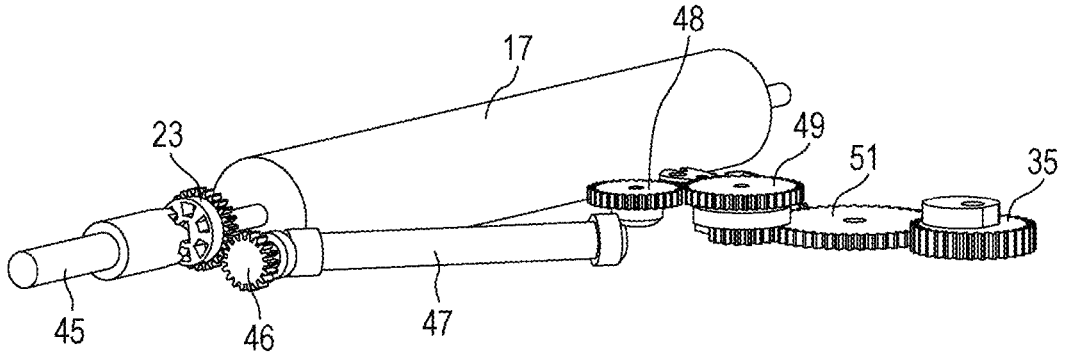

Subsequently, the drive transmission route to the rotating cam 35 will be described with reference to FIGS. 7A and 7B. FIGS. 7A and 7B are schematic views for explaining drive transmission to the rotating cam 35. The image forming apparatus is provided with a drive source, not illustrated, for driving the driving roller 17. The drive transmission from the drive source to the driving roller 17 is performed by engagement between a drive input unit 45 provided in the image forming apparatus and a coupling gear 23 provided in the intermediate transfer unit. Engagement between the drive input unit 45 and the coupling gear 23 may be released selectively, whereby the intermediate transfer unit may be demounted from the image forming apparatus.

A drive force input to the coupling gear 23 is branched and is transmitted to a clutch gear 49 via a first gear 46, a gear shaft 47, and a second gear 48. Here, a drive transmission unit is composed of the first gear 46, the gear shaft 47, the second gear 48, and the clutch gear 49.

The clutch gear 49 is configured to control drive transmission to an output gear 51 by a solenoid 50 as a drive transmission switching member, and the output gear 51 is driven only when an operation signal from a control unit, not illustrated, is sent to the solenoid 50. The output gear 51 is configured to rotate the rotating cam 35 by approximately 180° every time when the solenoid 50 is operated. Here, according to the configuration of this embodiment, the drive transmission to the output gear 51 is selectively transmitted by the clutch gear 49 and the solenoid 50. However, what is essential is that the drive transmission can be controlled. Therefore, an electromagnetic clutch or the like may be used.

In this manner, the separating unit 24 provided in the intermediate transfer unit 10 is capable of moving the respective primary transfer rollers by a drive force transmitted from the drive source that drives the driving roller 17, so that reduction in size is achieved without providing a specific drive source. In addition, with the provision of the drive transmitting unit that transmits the drive force transmitted from the drive source to the separating unit 24 only when needed in the intermediate transfer unit 10, reduction in size of the apparatus body is achieved. Furthermore, with a configuration in which the separating unit 24 and the drive transmitting unit are arranged in an area formed by being stretched by the stretching roller of the intermediate transfer unit 10, increase in size of the intermediate transfer unit 10 may be suppressed.

Other Embodiments

The image forming apparatus of the above-described embodiment is the image forming apparatus provided with the intermediate transfer belt unit as the belt conveying apparatus. However, the belt conveying apparatus of this invention or the image forming apparatus having the belt conveying apparatus is not limited thereto. In other words, a conveying belt unit provided with a conveying belt configured to convey the recording material on which the toner image is directly transferred from the photosensitive drum may be employed as a belt conveying apparatus. Since the configurations of the respective image forming units are the same as those in the image forming apparatus of the first embodiment, description will be omitted.

Specifically, the conveying belt unit 160 includes a conveying belt 110 configured to convey a recording medium, and a drive roller 60 configured to circulate the conveying belt 110 while stretching the conveying belt 110. In addition, the conveying belt unit 160 includes a tension roller 70 configured to be urged by an urging member for applying tension while stretching the conveying belt 110, a plurality of transfer member 220, and the separating unit 24.

Figure 8:
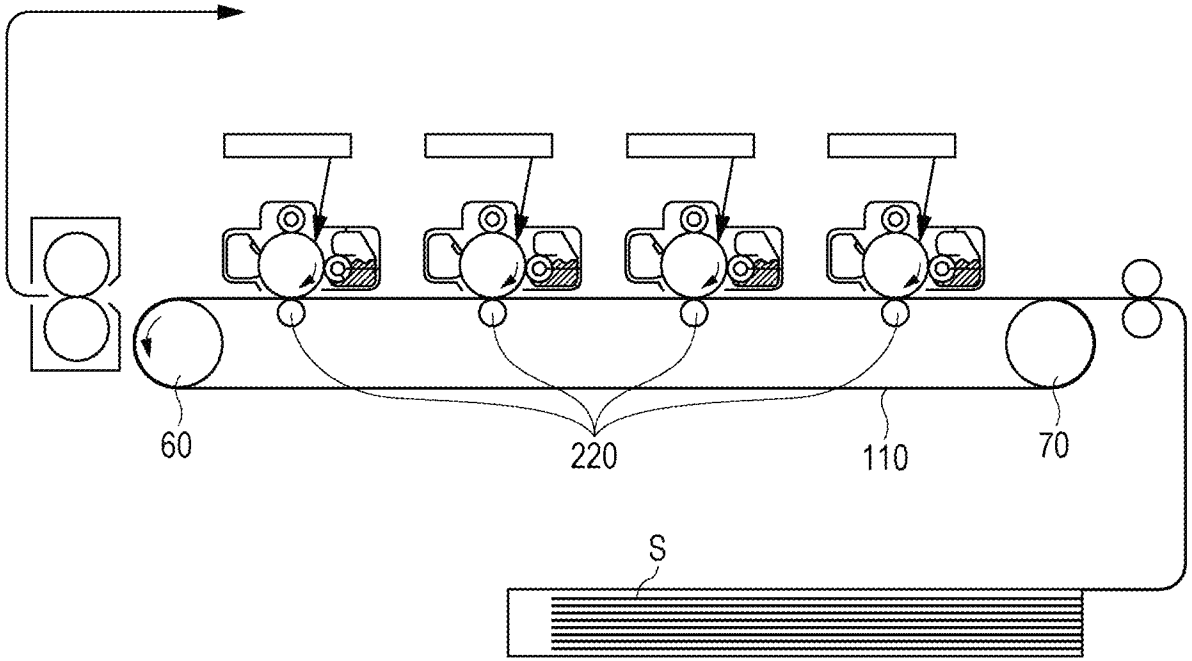
FIG. 8 is a schematic side view of an image forming apparatus of another embodiment.

FIG. 8 illustrates a schematic side view of the image forming apparatus according to another embodiment of this invention. As illustrated in FIG. 8, a recording medium fed from the sheet tray is delivered to the circulating conveying belt 110 at a good timing for forming images in this embodiment.

The transfer medium S carried on the conveying belt 110 is conveyed to transfer nips with respect to the respective photoconductive drums 1*a* to 1*d* at a good timing and, at these transfer nips, toner images are transferred directly from the photoconductive drums 1*a* to 1*d*.

In this configuration, reduction in size of the conveying belt unit 160 and the apparatus body is achieved by employing a configuration in which a drive force is transmitted from the drive source that drives the drive roller to the separating unit 24 when moving the plurality of the transfer members 220.

According to this invention, with a configuration in which the transfer member is moved without providing a specific drive source, a belt conveying apparatus capable of reduction in size and an image forming apparatus provided with the belt conveying apparatus may be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-261453, filed in Nov. 29, 2012, which is hereby incorporated by reference herein in its entirety.

What is claimed is:

1. A belt conveying apparatus provided in an image forming apparatus that is configured to transfer a toner image from an image bearing member that carries the toner image to a transfer medium, comprising:

an endless belt that moves in a direction of conveyance;

a plurality of stretching members configured to stretch the endless belt;

a drive roller, which is one of the plurality of stretching members, configured to stretch the endless belt and convey the endless belt;

a transfer member arranged corresponding to the image bearing member configured to carry the toner image via the endless belt;

a separating unit configured to cause the transfer member to move to a pressing position where the image bearing member is pressed via the endless belt and a separated position separated from the image bearing member in comparison with the pressing position;

a drive unit configured to transmit a drive force from a drive source provided in an apparatus body to the drive roller, and a drive transmitting unit configured to transmit the drive force branched and transmitted from the drive force to the separating unit, wherein the separating unit moves the transfer member by the drive force transmitted by the drive transmitting unit via the drive unit.

2. The belt conveying apparatus according to claim 1, further comprising:

a drive transmission switching member configured to transmit a drive force from the drive transmitting unit to the separating unit only when the transfer member is moved by the separating unit and not to transmit the drive force from the drive transmitting unit to the separating unit when the transfer member is not moved by the separating unit.

3. The belt conveying apparatus according to claim 2, wherein the separating unit, the drive transmitting unit, and the drive transmission switching member are arranged on an inside of both ends of the endless belt in a belt width direction orthogonal to the direction of conveyance of the endless belt.

4. The belt conveying apparatus according to claim 2, wherein the separating unit, the drive transmitting unit, and the drive transmission switching member are arranged within an area defined by the endless belt stretched by the plurality of stretching members.

5. The belt conveying apparatus according to claim 4, wherein the separating unit includes a position control member configured to control the position of the transfer member by moving substantially in parallel to the direction of belt conveyance of the endless belt.

6. The belt conveying apparatus according to claim 5, wherein the separating unit includes a cam member configured to rotate substantially in parallel to the direction of conveyance of the endless belt by being transmitted with the drive force by the drive force transmitting unit, and the movement of the position control member is controlled by the cam member.

7. The belt conveying apparatus according to claim 6, wherein the separating unit includes a link member configured to engage the position control member and the cam member, and pivots substantially in parallel to the surface of the endless belt about a pivotal shaft.

8. The belt conveying apparatus according to claim 7, wherein the position control members are provided at both ends of the transfer member in the belt width direction, respectively, and the cam member is arranged at a center in the belt width direction.

9. An image forming apparatus comprising:

a drive source;

a plurality of image bearing members configured to carry a tonner image; and a belt conveying apparatus configured to convey toner images for transferring the toner images carried by the plurality of image bearing members to a transfer material, the belt conveying apparatus including: an endless belt that moves in the direction of belt conveyance; a plurality of stretching members configured to stretch the endless belt; a drive roller, which is one of the plurality of stretching members, and configured to stretch the endless belt and convey the endless belt; a plurality of transfer members arranged corresponding to the plurality of image bearing members configured to carry the toner image thereon via the endless belt, and a separating unit configured to move at least one of the plurality of transfer members to a pressing position where the image bearing members are pressed via the endless belt and a separated position separated from the image bearing members in comparison with the pressing position, wherein the belt conveying apparatus includes: a drive unit configured to transmit a drive force from the drive source to the drive roller, and a drive transmitting unit configured to transmit the drive force branched and transmitted from the drive unit to the separating unit, wherein the separating unit moves the transfer member by a drive force transmitted by the drive transmitting unit via the drive unit.

10. The image forming apparatus according to claim 9, wherein the belt conveying apparatus includes a drive transmission switching member configured to transmit a drive force from the drive transmitting unit to the separating unit only when the transfer member is moved by the separating unit and not to transmit the drive force from the drive transmitting unit to the separating unit when the transfer member is not moved by the separating unit.

11. The image forming apparatus according to claim 10, wherein the separating unit, the drive transmitting unit, and the drive transmission switching member are arranged on the inside of both ends of the endless belt in a belt width direction orthogonal to the direction of conveyance of the endless belt, and within an area defined by the endless belt stretched by the plurality of stretching members.

12. The image forming apparatus according to claim 9, wherein the plurality of image bearing members are configured to carry toner images having different colors from each other, the different colors including at least black, and a color mode in which image formation is performed on all of the image bearing members in a state in which all of the plurality of transfer members are positioned at the pressing positions and a monochrome mode in which image formation is performed on the image bearing member carrying the black toner image in a state in which the transfer member corresponding to the image bearing member carrying the black toner image is positioned at the pressing position and in a state in which the plurality of transfer members corresponding to the image bearing members other than the image bearing member carrying the black toner image are positioned at the separated positions are executable.

13. The image forming apparatus according to claim 12, wherein the separating unit moves the transfer members corresponding to the plurality of image bearing members other than the black image bearing member.

14. The image forming apparatus according to claim 9, wherein the separating unit includes a position control member configured to control the position of the transfer member by moving substantially in parallel to the direction of conveyance of the endless belt.

15. The image forming apparatus according to claim 14, wherein the separating unit includes a cam member configured to rotate substantially in parallel to the direction of conveyance of the endless belt by being transmitted with the drive force by the drive force transmitting unit, and the movement of the position control member is controlled by the cam member.

16. The image forming apparatus according to claim 15, wherein the separating unit includes a link member configured to engage the position control member and the cam member, and pivot substantially in parallel to the direction of conveyance of the endless belt about a pivotal shaft.

* * * * *